US006139286A

United States Patent [19]

Muscarella

[11] Patent Number: 6,139,286

[45] Date of Patent: Oct. 31, 2000

[54] AUTOMATIC VENTING BACK PRESSURE VALVE

[75] Inventor: Stephen B. Muscarella, Henrietta, N.Y.

[73] Assignee: Pulsafeeder, Inc., Rochester, N.Y.

[21] Appl. No.: 09/162,049

[22] Filed: Sep. 28, 1998

[51] Int. Cl.[7] ..... F04B 49/00

[52] U.S. Cl. ..... 417/305

[58] Field of Search ..... 417/305, 307, 417/435

[56] References Cited

U.S. PATENT DOCUMENTS

| | | | |
|---|---|---|---|
| 4,682,625 | 7/1987 | Christopher | 137/538 |
| 5,205,722 | 4/1993 | Hammond | 417/395 |
| 5,647,733 | 7/1997 | Augustyn et al. | 417/360 |
| 5,667,368 | 9/1997 | Augustyn et al. | 417/385 |
| 5,676,531 | 10/1997 | Muscarella et al. | 417/413.1 |
| 5,860,793 | 1/1999 | Muscarella et al. | 417/388 |

*Primary Examiner*—Teresa Walberg
*Assistant Examiner*—Vinod D Patel
*Attorney, Agent, or Firm*—Hill & Simpson

[57] ABSTRACT

A new and improved automatic venting back pressure valve is provided in a valve body including a back pressure chamber having a fluid inlet and a fluid outlet. A spring loaded back pressure member covers the fluid outlet which is movable between a normally closed position wherein the back pressure member seals off the fluid outlet and an open position wherein the back pressure member is displaced from the fluid outlet to permit fluid to flow through the back pressure chamber from fluid inlet to fluid outlet in response to increased fluid pressure in the back pressure chamber. A gas by-pass orifice is disposed in an upper portion of the back pressure chamber which connects the back pressure chamber to a downstream portion of the fluid outlet. The gas by-pass orifice has a diametrical dimension selected to permit flow of gases through the orifice but to substantially not permit flow of liquids through the orifice. Air or gas entering the back pressure valve is automatically vented from the back pressure chamber as the valve fills with each pump stroke to maintain hydraulic firmness and provide improved more accurate fluid flow.

20 Claims, 5 Drawing Sheets

AUTOMATIC VENTING BACK PRESSURE VALVE

BACKGROUND OF THE INVENTION

The present invention generally relates to liquid metering pumps for delivering controlled amounts of liquid from one vessel to another, or from a source of supply to a process stream. More particularly, it relates to a new and improved automatic venting back pressure valve for use on a liquid metering pump to provide a desirable back pressure to ensure that the metering pump meters fluids accurately.

Diaphragm metering pumps are known and used for transferring fluids from one place to another. Generally, diaphragm pumps include a pumping head area including a product chamber bounded on one side by a displacable diaphragm member. The inlet and exit to the product chamber are provided with one way check valves. As the diaphragm is displaced away from the product chamber, the exit check valve closes under reduced pressure, the inlet check valve opens and fluid is drawn into the product chamber. Thereafter, as the diaphragm is displaced toward the product side, pressure increases on the fluid in the product chamber, closing the inlet check valve, opening the outlet check valve and forcing fluid in the product chamber out of the exit. In continuous operation, a diaphragm pump pumps fluid through the product side in a pulsed manner.

Diaphragm displacements may be achieved with a mechanical drive system or an hydraulic drive system. An example of the mechanical drive is a solenoid pump. In a solenoid pump, a diaphragm actuator rod is secured at one end to the diaphragm and at its opposed end is connected to a solenoid actuator. The electrically or electronically controlled solenoid is effective to cause reciprocal linear movement of the actuator and diaphragm actuator rod thereby causing displacements of the diaphragm directly.

In an hydraulically driven diaphragm metering pump, diaphragm displacement is achieved by varying the pressure of a hydraulic fluid on the hydraulic side of the diaphragm through operation of a reciprocating piston disposed in fluid communication with a hydraulic chamber. Instead of direct mechanical attachment to the diaphragm, with this type of pump, a hydraulic fluid is pressurized on one side of the diaphragm to cause diaphragm displacements toward or away from the product chamber. This also results in a pulsed pumping of a fluid through the pump head.

Excellent examples of these types of diaphragm metering pumps are described in commonly assigned U.S. Pat. No. 5,667,368 which issued Sep. 16, 1997 and U.S. Pat. No. 5,676,531 which issued Oct. 14, 1997. The disclosures of each of these prior patents are specifically incorporated herein by reference.

All diaphragm metering pumps require some back pressure to meter fluids accurately. This pressure may range from about 5 to 35 psi, preferably from about 10 to about 25 psi. Back pressure is necessary to ensure proper check valve re-seating for the product outlet or discharge ball check valve. A lack of back pressure causes or permits fluid flow through in excess of theoretical flow. The use of a back pressure valve assists in providing required back pressure and is especially useful when pumping fluids into a lower or no pressure receptacle or system in order to maintain metering accuracy.

A problem which may arise in diaphragm metering pumps occurs during operation if a volume of air is sucked into the intake lines so that air travels through the suction line, or after sitting idle, gas accumulates in the pump head. Air or gas in the intake or pump head may cause the pump to lose prime. If the pump loses its prime and gas fills the diaphragm metering pump head area, because of the compressability of gas, pumping displacements of the diaphragm may simply compress the gas and not result in any liquid pumping or fluid flow. If there is a loss of priming, frequently a pump can not regain hydraulic firmness and restart pumping.

Accordingly, it is an object of the present invention to provide a new and improved automatic venting back pressure valve which provides a gas by-pass feature allowing trapped air or gas to be pumped and moved around a back pressure restriction device so that, in the event air is introduced into the pumping chamber, the air can be rapidly removed and the pump can self prime to resume pumping liquid.

SUMMARY OF THE INVENTION

In accordance with this and other objects, the present invention provides a new and improved automatic venting back pressure valve for diaphragm metering pumps. The automatic venting back pressure valve may be disposed in sealed, in-line relationship with the product discharge outlet port of a diaphragm metering pump typically including a one way ball check exit valve.

In an embodiment, the new and improved automatic venting back pressure valve comprises a valve body including a back pressure chamber having a fluid inlet and a fluid outlet. A spring loaded back pressure member covers the fluid outlet which is movable between a normally closed position wherein the back pressure member seals off the fluid outlet and an open position wherein the back pressure member is displaced from the fluid outlet to permit fluid to flow through the back pressure chamber from fluid inlet to fluid outlet in response to increased fluid pressure in the back pressure chamber. A gas by-pass orifice is disposed in an upper portion of the back pressure chamber which connects the back pressure chamber to a downstream portion of the fluid outlet. The gas by-pass orifice has a diametrical dimension selected to permit flow of gases through the orifice but substantially not to permit flow of liquids through the orifice. Air or gas entering the back pressure valve is automatically vented from the back pressure chamber as the valve fills with each pump stroke to maintain hydraulic firmness and provide improved more accurate fluid flow.

In a preferred embodiment, the new and improved automatic venting back pressure valve comprises a valve body including an elongate cylindrical back pressure chamber having a horizontally oriented longitudinal axis. An inlet passageway connects the discharge outlet of a pumping head with a lower portion of the back pressure chamber. A raised cylindrical exit port projects inwardly into the back pressure chamber which has a sealing end face with an exit opening. The exit opening is fluidly connected with a product outlet passageway. An upper end of the back pressure chamber is provided with a gas by-pass orifice which extends at one end from the back pressure chamber to an opposed end communicating with the product discharge passageway. The end sealing surface on the cylindrical projection surrounding the exit opening and one side of the back pressure chamber is covered by a spring loaded back pressure member. The back pressure member is spring loaded against the end sealing surface to close off the exit opening in a normally closed position.

During a compression or pumping pulse from the diaphragm metering pump, fluid flows from the product discharge outlet of the pump head into the inlet passageway.

Any gas included in this entering fluid rises to the top of the back pressure chamber. On increased pressure, the gas is forced through the gas by-pass orifice to remove all gas from the system until liquid enters the orifice. The orifice has a diameter selected to permit gases to flow easily therethrough but which does not substantially permit liquid flow due to the increased viscosity of liquid. As soon as all air or gas has been vented from the back pressure chamber and liquid has contacted the gas by-pass orifice, the back pressure chamber fills with liquid, liquid flow is effectively prevented and internal pressure within the back pressure chamber increases. As the internal pressure increases to a sufficient amount, the pressure will move the spring loaded back pressure member away from the exit opening, against the force of the spring, to permit fluids to exit the back pressure chamber through the exit opening and product outlet passageway.

As the diaphragm metering pump cycles from compression mode to fill mode and as the pressure in the back pressure chamber falls, the spring loaded back pressure member moves to its normally closed position closing off the exit opening, permitting the one way ball check valve on the pump discharge port to fully close to prevent leaking or excess fluid flow through the discharge end. It was unexpected that intentionally providing a leak in the back pressure system would result in less actual leakage and improved, more accurate metering.

The new and improved automatic venting back pressure valve in accordance with the present invention preferably includes large bore, generous interior passages to reduce or eliminate any surface tension or capillary issues, so that air bubbles will not be trapped to prevent hydraulic firmness from being maintained or regained.

In accordance with the new and improved automatic venting back pressure valve, the gas by-pass orifice permits trapped air or gas to be bled through the orifice and once the air is gone, the fluid will also leak but because of the vast difference between the viscosity of air and liquids, the leakage of liquids through the orifice is near zero. Tests have verified that pump metering accuracy is not effected by a measurable amount. Once the air is by-passed, the pump resumes pumping liquid and the pump is able to hydraulically lift the back pressure member against the spring biasing feature to resume pumping. Time for gas removal will vary based on the quantity of air or gas, however the new and improved automatic venting back pressure valve of this invention may remove two feet of air in a suction line in a short time period of from about 30 seconds to 1.5 minutes.

In accordance with a preferred embodiment, if the amount of air in the line is extreme, a manual override lever may be provided to lift the spring loaded back pressure member against the spring to maintain the exit opening in an open condition. This reduces the back pressure to near zero for fast priming.

Other objects and advantages of the present invention will become apparent from the following Detailed Description and the Drawings, in which:

DETAILED DESCRIPTION OF THE PREFERRED EMBODIMENT

Figure 1:
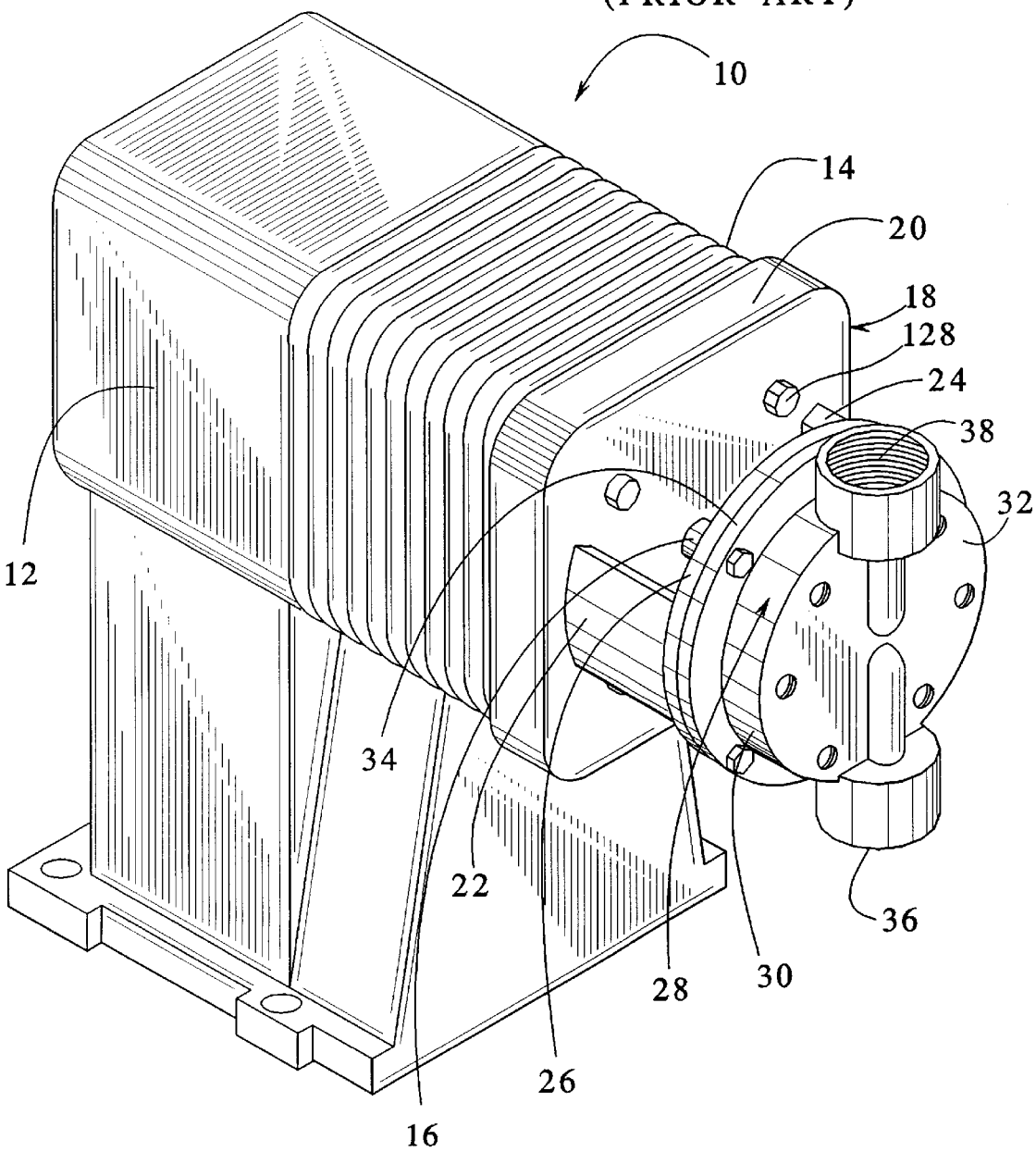
FIG. 1 (PRIOR ART)
FIG. 1 is a perspective view of a conventional solenoid-type liquid metering pump and pump head.

In accordance with the present invention, the new and improved automatically venting back pressure valve is adapted for use with a fluid metering pump such as a solenoid driven liquid metering pump 10 shown in FIG. 1. Liquid metering pump 10 includes a pump housing 12 enclosing an electrically or electronically controlled solenoid actuator system having a front end 14 with a solenoid actuator rod 16 projecting therefrom, a generally H-shaped mounting bracket 18 including a pump mounting plate 20, a pair of spacer arms 22 and 24 and a head mounting plate 26 is mounted on the front end 14 of pump housing 12. An autoclavable pump head assembly 28 is shown mounted to head mounting plate 26 on mounting bracket 18.

Electronic solenoid liquid metering pumps such as 10 are well known to those skilled in this art and several models are commercially available from a number of sources. An excellent liquid metering pump, for use herein, is commercially available under the PULSAtron® series trade name, available from Pulsafeeder, Inc., Rochester, N.Y.

The autoclavable pump head assembly 28 shown in FIG. 1 comprises a pump head body 30 including a front end 32 and an opposed rear end 34. A lower threaded product inlet opening 36 is provided as well as an upper threaded product discharge opening 38. A product chamber is defined in the interior of the pump head body 30 and the displacable diaphragm is located in the interior of pump head body 30 as well.

Figure 2:
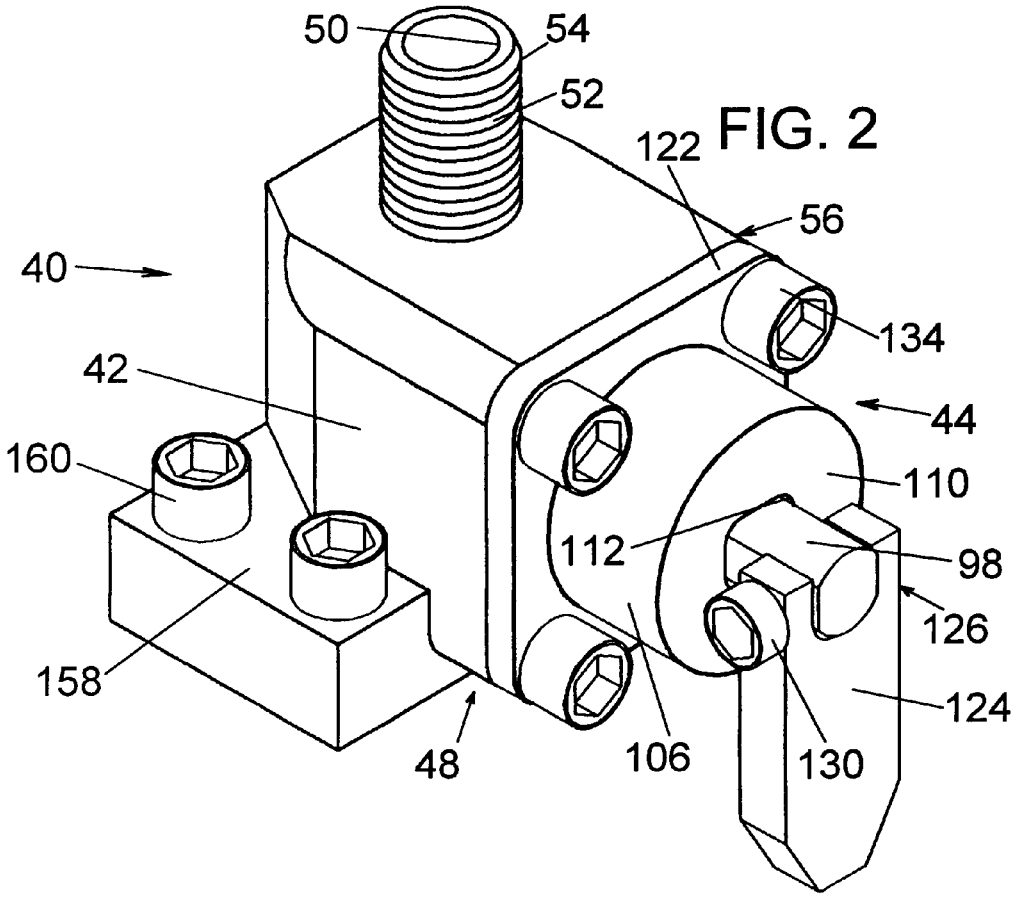
FIG. 2 is a perspective view of the new and improved automatic venting back pressure valve in accordance with an embodiment of the present invention.
Figure 5:
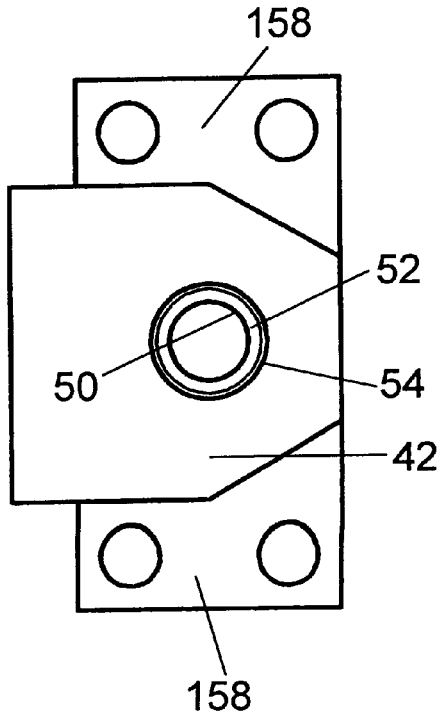
FIG. 5 is a top plan view of the valve body of the new and improved automatic venting back pressure valve of the present invention.
Figure 3:
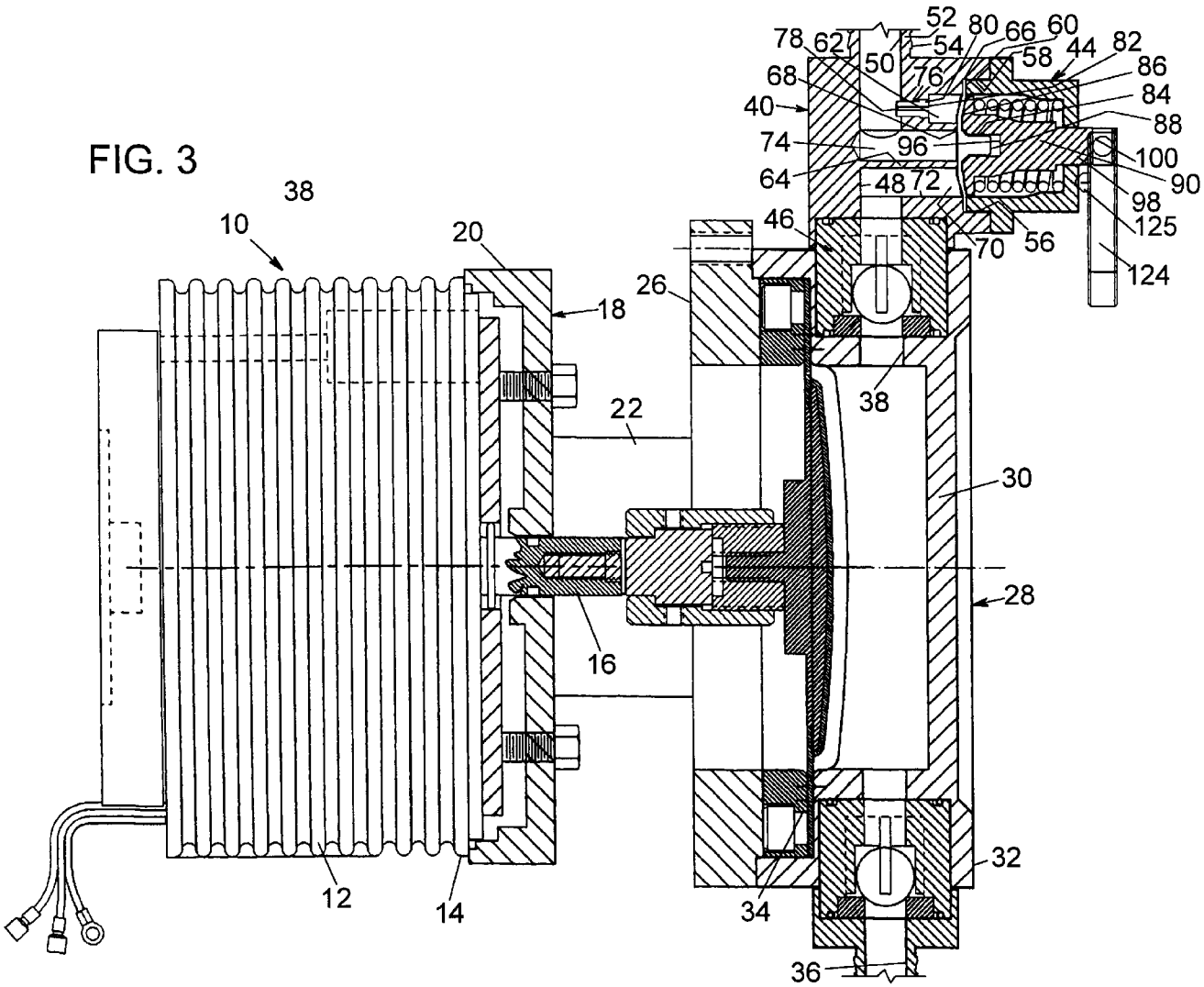
FIG. 3 is an elevated cross-sectional view of the new and improved automatic venting back pressure valve of the preferred embodiment, shown installed and in use with an autoclavable pump head assembly and solenoid type fluid metering pump.
Figure 4:
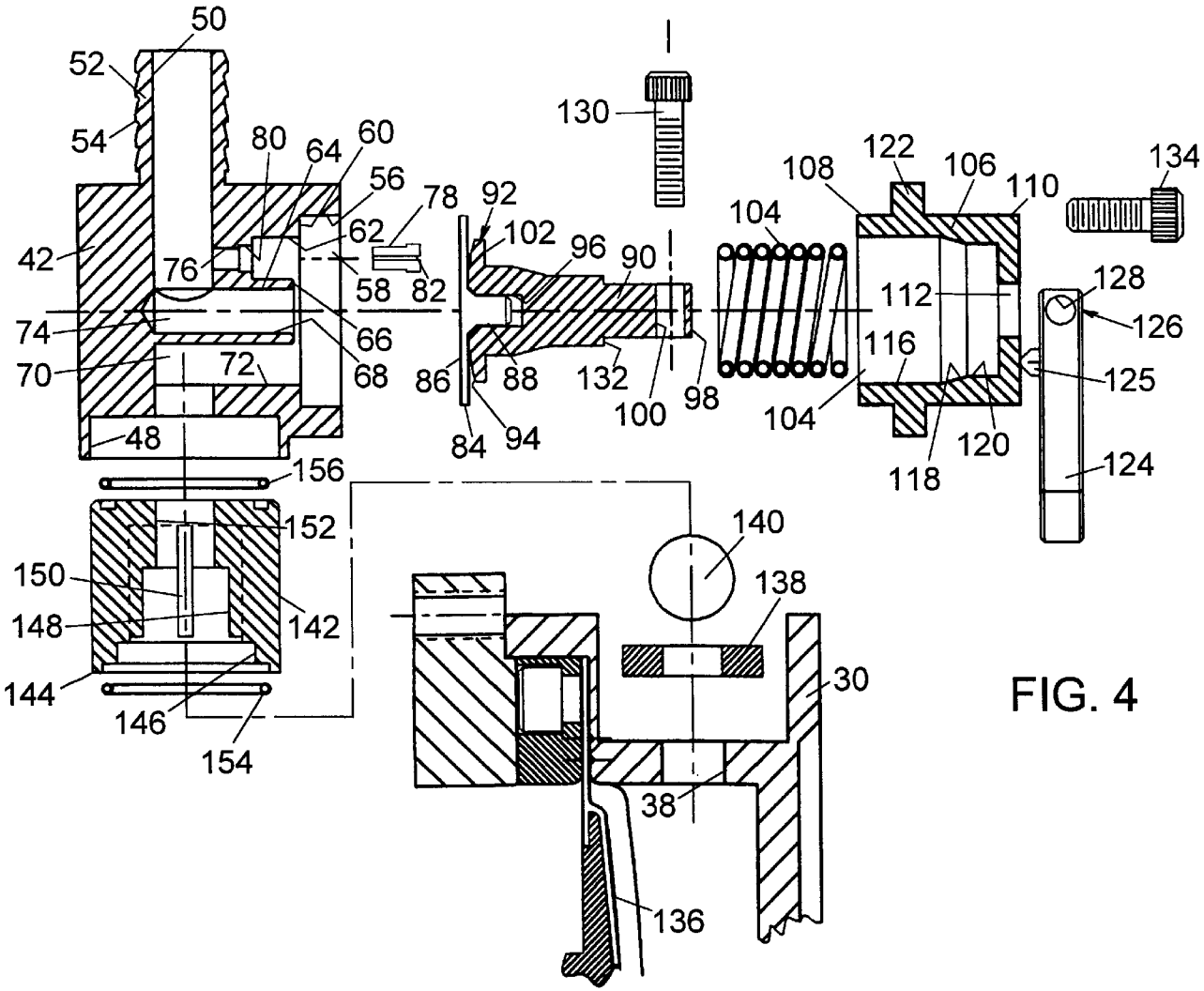
FIG. 4 is an exploded elevated cross-sectional view of the new and improved automatic venting back pressure valve.

Referring now to FIGS. 2–4, in accordance with the preferred embodiment, the present invention provides a new and improved automatic venting back pressure valve 40 adapted to be sealably connected and disposed in-line with a product discharge outlet of a pump head assembly, such as outlet 38 on fluid metering pump 10 as shown in FIG. 1. Back pressure valve 40 comprises a valve body 42, a back pressure diaphragm assembly 44 and a one way ball check product discharge valve assembly 46, best shown in FIGS. 3 and 4.

More particularly, as shown in FIGS. 2 and 5–7, valve body 42 includes a lower inlet opening 48 and an opposed outlet opening 50 provided at the end of a cylindrical hose connection projection 52. In the preferred embodiment depicted in FIGS. 2–7, the cylindrical hose connection projection 52 is provided with a ribbed circumferential surface 54 for providing secure press-on tubing engagement so that exiting fluids may be conveyed by tubing to a desired downstream location. Valve body 42 further includes a side opening 56 into which the spring loaded back pressure diaphragm assembly 44 is introduced and mounted.

Figure 7:
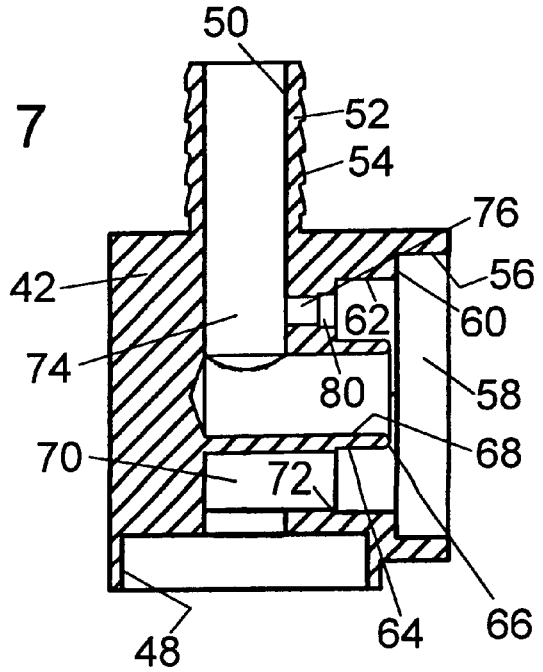
FIG. 7 is an elevated cross-sectional view of the valve body of the new and improved automatic venting back pressure valve of the invention taken along view line 7—7 in FIG. 6.

Valve body 42 includes a stepped recess 58 disposed inwardly adjacent a side opening 56 defining a bearing surface 60. The bearing surface 60 includes an annular recess 62. The annular recess 62 in turn defines a central cylindrical portion 64 having an end sealing surface 66 with an exit opening 68. The end sealing surface 66 is spaced inwardly from the bearing surface 60 as shown in FIGS. 4 and 7. Valve body 42 further includes an inlet passageway 70 extending from the lower inlet opening 48 to a first opening 72 in the lower portion of the annular recess 62. A product outlet passageway 74 extends from the exit opening 68 in the end sealing surface 66 to the upper outlet opening 50. In accordance with the preferred embodiment, a stepped gas by-pass mounting aperture 76 adapted to receive an orifice insert 78 extends between a second opening 80 in an upper portion of the annular recess 62 and the product outlet passageway 74.

Figure 6:
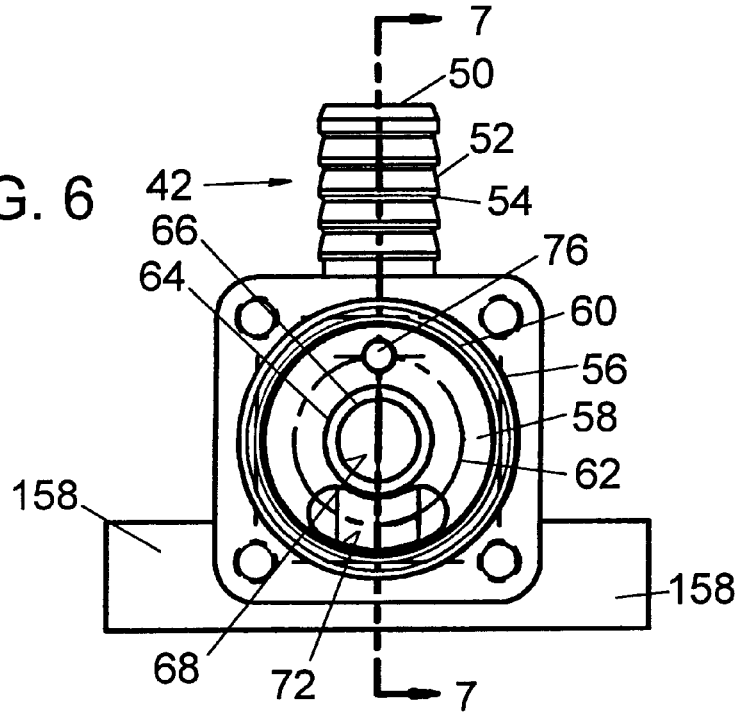
FIG. 6 is an elevated side view of the valve body of the new and improved automatic venting back pressure valve shown in FIG. 6.

As is best shown in FIG. 6, a back pressure chamber is defined adjacent a side opening 56 by the annular recess 62 and the concentric inward raised or projecting exit opening 68 provided by the central cylindrical portion 64. As shown in FIG. 6, any gas or air entering the first opening 72 in the lower portion of the annular recess 62 may flow around the central cylindrical portion 64 to accumulate in an upper portion of the annular recess 62 before being purged through the by-pass orifice 82 in the orifice insert 78 upon pumping displacements of the main pump diaphragm, as will be more completely described hereinafter.

The new and improved valve body 42 may comprise conventional metal or thermoplastic polymer materials having sufficient dimensional stability to withstand environmental conditions of the pumping environment. Especially preferred are metal or thermoplastic materials having sufficient dimensional stability to withstand elevated temperatures of autoclaving or sterilization processing. Accordingly, valve body 42 may comprise casted metal or machined metal such as aluminum alloy, stainless steel or other metal materials. The valve body may also comprise a thermoplastic polymer selected from polymers and copolymers derived from ethylenically unsaturated monomers, polyamides, polyesters, polycarbonates, or any other engineering thermoplastic employed in molding shaped articles. Preferably, valve body 42 has a unitary construction and especially preferably is a unitary thermoplastic molding made from glass-filled polypropylene, polyvinyl chloride, styrene-acrylonitrile copolymer or polyvinylidine fluoride. The materials may also include conventional additives such as pigments, stabilizers, and the like, all added in their conventional amounts.

In accordance with the preferred embodiment, the orifice insert 78 has an exterior configuration dimensioned to be sealably received within the stepped orifice aperture and has a centrally disposed gas by-pass orifice 82 specifically designed to permit rapid flow of gas but substantially no flow of liquids therethrough. In the alternative, orifice insert 78 may comprise more than one hole or may be porous sintered metal and still provide the selective transmission of gases but not liquids. Preferably, the orifice insert 78 is stainless steel and has a precision orifice 82 defined therein having a diametrical dimension of from about 0.001 inches to about 0.010 inches, depending on the fluid being pumped and the volumes being pumped through the back pressure valve.

The new and improved automatic venting back pressure valve 40 additionally comprises a back pressure diaphragm assembly 44 best shown in FIGS. 3 and 4. The diaphragm assembly 44 comprises a resilient T-shaped diaphragm member 84 including a substantially disk-like diaphragm portion 86 and a projecting mounting projection 88 extending from a central portion of one side of diaphragm portion 86. The diaphragm member 84 may comprise Teflon®, an elastomer, or a thermoplastic elastomer material and especially preferably may comprise a Teflon® coated thermoplastic elastomer. The diaphragm assembly 44 further includes a diaphragm shaft 90 also having a generally T-shaped configuration including a forward end 92 provided with a concave bearing surface 94 and including a central cylindrical depression 96 adapted to telescopically receive the mounting projection 88 of the diaphragm 84 in press fit engagement. The diaphragm shaft includes an opposed rear end 98 with a pass through mounting aperture 100, a rearward facing portion of the front end 92 of the diaphragm shaft 90 includes a spring bearing surface 102 adapted to contact one end of a coil spring 104 through which the diaphragm shaft 90 is inserted. The diaphragm assembly 44 further includes a spring block housing 106 including a front end portion 108, an opposed rear end portion 110 with a rear opening 112 and including a stepped interior cavity 114 including a forward portion 116, a frusto-conical tapering transition portion 118 and a rear spring mounting portion 120 having a reduced diameter compared to the front portion 116. A projecting mounting flange 122 extends outwardly on the spring block housing 106 at a point intermediate the front end 108 and rear end 110. In the preferred embodiment depicted in FIGS. 3 and 4, a toggle 124 is provided for manually operating the back pressure diaphragm 84.

As shown in FIGS. 3 and 4, the coil spring 104 is disposed on the diaphragm shaft 90 so that the front end of the coil spring 104 rests against the spring bearing surface 102 at the front end 92 of the diaphragm shaft member 90. The shaft 90 and spring 104 are inserted into the spring block housing 106 until the rear end 98 of the diaphragm shaft 90 projects outwardly from the rear opening 112 provided in the rear end 110 of the spring block housing 106. The upper end of the toggle 124 is provided with a fork portion 126 and includes threaded apertures 128 adapted to receive a threaded thumbscrew 130 having a shaft portion which is passed through a first fork, through a pass-through aperture 100 of the rear end 98 of a diaphragm shaft 90 and is threadably engaged in the opposed fork half of the toggle 124. The diaphragm shaft 90 is provided with a rearwardly directed shoulder at an intermediate point along its length defining a limit surface 132 to prevent over compression of the coil spring 104 and to prevent over-extension of the diaphragm 84. The limit surface 132 bottoms out against the interior end wall adjacent the rear end opening 112 of the rear end 110 of the spring block housing 106.

The assembled diaphragm assembly 44 is received into the side opening 56 of the valve body 42 until the central portion of the diaphragm 84 sealingly abuts and closes off the exit opening 68 of the central cylindrical portion 64. The radially outward or peripheral portions of the diaphragm portion 86 are engaged on the bearing surface 60 of the side opening 56 of the valve body 42. The front end 108 of the spring block housing 106 is telescopically received in the side opening 56 of the valve body 42 until the peripheral edge portion of the diaphragm 84 is sealably compressed between the front end surface 108 of the block housing 106 and the bearing surface 60 of the valve body. The diaphragm assembly 44 is mounted in position on the valve body 42 by threaded mounting bolts 134 best shown in FIG. 2.

In operation, the spring loaded back pressure diaphragm assembly 44 abuts the exit opening 68 in the end sealing surface 66 to close off the product outlet passageway 74.

This spring loaded closed position of the diaphragm assembly 44 is the normally closed condition back pressure valve 40. On pumping displacement of the diaphragm 136 from the metering pump 10, fluid flows into the inlet passageway 70 and into the annular recess 62. In the process, any gas that is present at the upper portion of the annular recess 62 will be vented through the gas by-pass orifice 82 until liquid is introduced to orifice 82. The gas by-pass orifice 82 in orifice insert 78 is dimensioned so that liquid does not substantially flow through it and as a result, fluid pressure builds up within the annular recess 62 until a pressure sufficient to overcome the biasing force of the coil spring 104 is achieved. Accordingly, this increased fluid pressure in the annular recess 62 is capable of displacing the diaphragm 84 against the spring 104 in a rightward direction as shown in FIGS. 3 and 4, so that the diaphragm 84 is spaced from the end sealing surface 66 and exit opening 68 of the central cylindrical portion 64 permitting fluid to flow from the inlet passageway 70 into the annular recess 62 and from the annular recess 62 around the cylindrical projection 64 into the exit opening 68 and out of the outlet passageway 74. As soon as fluid pressure in the annular recess 62 falls, the resilient coil spring 104 returns the diaphragm 84 into sealing engagement closing off the exit opening 68. The manual toggle 124 is provided to permit manual override. The toggle 124 may be gripped and urged leftwardly as shown against fulcrum projection 125 to move diaphragm shaft 90 rightwardly as shown in FIGS. 3 and 4 to maintain the diaphragm 84 off of the exit opening 68 to maintain the valve 40 in an open condition so that gas, air or liquids may be rapidly pushed through the valve body 42 and out the exit opening 68. The structural elements of the diaphragm assembly 44 including the diaphragm shaft 90, the spring block housing 106 and the toggle 124 may comprise a metal material or a thermoplastic polymer material, as set forth above in connection with the valve housing 42. The coil spring 104 is preferably stainless steel or corrosion resistant steel, e.g., nickel-plated music wire and has a spring rate intended to provide the required back pressure.

The automatic venting back pressure valve 40 further includes a discharge ball check valve assembly 46 as shown in FIGS. 3–4. The discharge check valve assembly 46 comprises a valve seat 138, a ball check 140 and a valve housing 142. Valve housing 142 includes a front end opening 144 with a stepped recess 146 adapted to closely receive valve seat 138, an interior passageway 148 including veined guides 150 provided to assist in accurately reseating the ball check 140 on suction stroke of the solenoid pump 10 and an upper discharge opening 152. A pair of O-ring seals 154, 156 are provided at the lower opening 144 and upper opening 152 of the valve housing 142 to provide for sealed in-line engagement of the discharge ball check valve 46 between the pump head discharge opening 38 and the lower inlet opening 48 of the valve body 42. Sealed engagement is provided by compression afforded by the lateral mounting flange 158 provided on the valve body 42 as shown in FIG. 2 and threaded mounting bolts 160 for tightly mounting the valve body 42 against the pump head 28 thereby compressing the outlet discharge ball check valve 46 between the pump head 28 and the valve body 42.

In accordance with the present invention, the discharge check valve assembly 46 is integral to the back pressure valve 40 which minimizes air spaces for better air pumping efficiency. In accordance with the preferred embodiment, the automatic venting back pressure valve 40 is provided with generous interior passages, such as inlet passageway 70 and outlet passageway 74, so that any tendency of air to stick or not move through tight passages may be reduced or eliminated. Preferably, the inlet passageway 70 and outlet passageway 74 each have large internal diameters of about 0.25 inches so that air bubbles can not be trapped therein preventing hydraulic firmness from being obtained.

A major advantage provided by the new and improved back pressure valve 40 of the present invention is that the valve design incorporates a small precision orifice 82 that allows a direct path around the back pressure restriction device 44 for improved air removal. The orifice 82 is effective to by-pass any air or gas trapped before the back pressure restriction 84. The valve by-pass feature and by-pass orifice allows trapped air or gas to be bled through the orifice at the beginning of each compression or pumping stroke. Once the air is gone from the back pressure chamber the fluid may also leak through the orifice but because of the vast difference between the viscosity of air and liquids, this leakage is near zero. The new and improved back pressure valve 40 of the present invention has been tested and it has been verified that pump metering accuracy is not effected by any measurable amount due to this leakage through the orifice 82. Time varies based on the quantity of air that may be introduced into the valve system, but two feet of suction line with air in it can typically be evacuated in from about 30 to about 60 seconds. If the amount of air in the pump and system is extreme, the toggle or manual override lever 124 is provided to lift the back pressure diaphragm 84 to reduce back pressure to near zero for faster priming.

Although the present invention has been defined with respect to certain preferred embodiments, modifications or changes may be made therein by those skilled in this art. For example, the cylindrical hose connection projection 52 is provided with a barbs or ribs 54 for use with tubing. The pump and valve output might also be changed to any exit or coupling configuration known to those skilled in the art. The valve 40 is available in stainless steel and Teflon®, but may be made from any of the other disclosed materials. As shown in the preferred embodiment, the discharge ball check valve assembly 46 is separate from the pump head 28 and may be made integral to the back pressure valve 40 although the back pressure valve 40 might be employed with a pump head having an integral ball check discharge valve already installed. Although the back pressure member described in the preferred embodiment is a back pressure diaphragm member 84, other spring loaded back pressure members known to those skilled in this art may readily be substituted, such as for example a spring loaded ball check or a spring loaded poppet. A change over to accommodate these alternative spring loaded back pressure members will be readily apparent to those skilled in this art. The above-mentioned patents are specifically incorporated herein by reference, for example the solenoid actuator and autoclavable pump head with its diaphragm actuating system shown in FIG. 3 is fully described in U.S. Pat. No. 5,676,531 and details of construction and operation of that portion of the figure may be obtained from that patent.

Although FIG. 3 shows the new and improved back pressure valve installed in use with a solenoid type diaphragm metering pump, the new and improved back pressure valve 40 might also be installed on the discharge of an hydraulically actuated diaphragm metering pump. All such obvious modifications or changes may be made herein by those skilled in the art without departing from the scope and spirit of this invention as defined by the appended claims.

What is claimed is:

1. An automatically venting back pressure valve comprising:

a valve body including a back pressure chamber having a fluid inlet, a fluid outlet and a spring loaded back pressure member covering the fluid outlet movable between a normally closed position wherein the back pressure member seals off the fluid outlet and an open position wherein the back pressure member is displaced from the fluid outlet to permit fluid to flow from inlet to outlet in response to increased fluid pressure in said back pressure chamber, said valve body further including a gas by-pass orifice disposed in an upper portion of the back pressure chamber and connecting the back pressure chamber to a downstream portion of the fluid outlet, the gas by-pass orifice having a diametrical dimension selected so that gases pass through the by-pass orifice but liquids substantially do not flow through the by-pass orifice.

2. A back pressure valve as defined in claim 1, wherein the valve body comprises metal.

3. A back pressure valve as defined in claim 1, wherein the valve body comprises a thermoplastic polymer material.

4. A back pressure valve as defined in claim 1, wherein the valve body has a unitary construction.

5. A back pressure valve as defined in claim 1, wherein the diametrical dimension of the gas by-pass orifice is from about 0.001 to about 0.010 inches.

6. An automatic venting back pressure valve comprising:

a valve body including a lower inlet opening sealably connectable to a product discharge outlet of a fluid metering pump, an opposed upper outlet opening, and a side opening, said valve body further including a stepped recess disposed inwardly adjacent the side opening defining a bearing surface, the bearing surface including an annular recess defining a central cylindrical portion having an end sealing surface with an opening, the end sealing surface being spaced inwardly from the bearing surface, said valve body further including an inlet passageway extending from said lower inlet opening to a first opening in a lower portion of the annular recess, a product outlet passageway extending from the opening in the end sealing surface to the upper outlet opening, and a gas by-pass orifice extending between a second opening in an upper portion of the annular recess and the product outlet passageway; and a spring-loaded back pressure member disposed against the bearing surface and covering the side opening, said back pressure member being movable in response to increasing pumping fluid pressure in the product inlet passageway between a normally closed position, wherein the back pressure member abuts the opening in the end sealing surface to close off the product outlet passageway, and an open position wherein the back pressure member is spaced from the opening in the end sealing surface to open the product outlet passageway, the gas by-pass orifice having a diametrical dimension such that gases pass through the orifice but liquids substantially do not pass through the orifice.

7. A back pressure valve as defined in claim 6, wherein the end sealing surface is substantially parallel to the bearing surface.

8. A back pressure valve as defined in claim 6, wherein the valve body comprises metal.

9. A back pressure valve as defined in claim 6, wherein said valve body comprises a molded thermoplastic polymer material.

10. A back pressure valve as defined in claim 6, wherein said gas by-pass orifice has a diametrical dimension of about 0.006 inches.

11. A back pressure valve as defined in claim 6, wherein the inlet passageway has a diametrical dimension of about 0.25 inches.

12. A back pressure valve as defined in claim 6, wherein the product outlet passageway has a diametrical dimension of about 0.25 inches.

13. A back pressure valve as defined in claim 6, wherein the back pressure member comprises a diaphragm.

14. A back pressure valve as defined in claim 6, wherein the back pressure member comprises a Teflon® diaphragm.

15. A back pressure valve as defined in claim 6, wherein said back pressure member comprises a spring loaded poppet member.

16. A back pressure valve as defined in claim 6, wherein said back pressure member comprises a spring loaded ball check.

17. A back pressure valve as defined in claim 6, further comprising a manual override lever connected to the back pressure member which is manually manipulatable to override the spring to maintain the back pressure member in an open position to reduce the back pressure to near zero for fast priming.

18. A back pressure valve as defined in claim 6, wherein said upper outlet opening is defined in a cylindrical projection extending from the valve body having a ribbed exterior configuration for permitting a press-on engagement of resilient tubing for conveying pumped fluids away from the back pressure valve.

19. A back pressure valve as defined in claim 6, wherein the lower inlet opening is sealably connected with a one-way ball check valve which is in turn sealably connected with a product discharge outlet of a pump head of a fluid metering pump.

20. A back pressure valve as defined in claim 6, wherein a spring loaded back pressure member is designed to provide a back pressure of from about 5 to about 35 psi.

* * * * *